United States Patent [19]

Borrelli et al.

[11] 4,323,640

[45] Apr. 6, 1982

[54] POSITIVE IMAGING METHOD USING DOPED SILVER HALIDE MEDIUM

[75] Inventors: Nicholas F. Borrelli, Elmira, N.Y.; Peter L. Young, North Wales, Pa.

[73] Assignee: Corning Glass Works, Corning, N.Y.

[21] Appl. No.: 204,165

[22] Filed: Nov. 5, 1980

[51] Int. Cl.[3] ..... G03C 5/24; G03C 1/76

[52] U.S. Cl. ..... 430/353; 430/351; 430/502; 430/495; 430/523

[58] Field of Search ..... 430/353, 351, 502, 495, 430/523

[56] References Cited

U.S. PATENT DOCUMENTS

| | | | |
|---|---|---|---|
| T966,00 | 1/1978 | Maskasky | 430/502 |
| 2,945,771 | 5/1955 | Mansfeld | 430/935 |
| 3,219,448 | 10/1962 | Lu Valle et al. | 430/567 |
| 3,219,452 | 11/1965 | Hartouni | 430/935 |
| 3,368,895 | 8/1963 | Matejec et al. | 430/502 |
| 3,512,869 | 10/1966 | Plumat et al. | 350/160 |
| 3,658,540 | 4/1972 | Malinowski | 430/495 |
| 3,875,321 | 4/1975 | Gliemeroth et al. | 428/432 |
| 4,275,141 | 6/1981 | Borrelli et al. | 430/495 |

FOREIGN PATENT DOCUMENTS 2236196 1/1975 France .

OTHER PUBLICATIONS

"AgCl–CuCl Photochromic Coatings," by A. F. Perveyev and A. V. Mikhaylov, *Sov. J. Opt. Tech.*, Feb. 1972, pp. 117–118.

"Evaporated Silver Bromide as a Photoraphic Recording Medium," A. Shepp et al., *Photographic Science and Engineering*, vol. 11, No. 5, Sep.–Oct. 1967.

*Primary Examiner*—Won H. Louie, Jr.

*Attorney, Agent, or Firm*—Kees van der Sterre

[57] ABSTRACT

A photosensitive medium suitable for storing positive images and a method of using it are provided, the medium being a multilayer film comprising $SnO_2$ and doped silver chloride and the method comprising an exposure step for negative imaging and a heating step for image reversal.

4 Claims, 2 Drawing Figures

POSITIVE IMAGING METHOD USING DOPED SILVER HALIDE MEDIUM

BACKGROUND OF THE INVENTION

The present invention relates to the use of photosensitive media to store images and specifically to the use of a particular doped silver halide-tin oxide medium to store positive images.

The use of evaporated binder-free silver halide layers as photographic media has long been known. A good summary of the patent literature in this field is found in the U.S. Defensive Publication of Maskasky, T966,003 of Jan. 3, 1978. U.S. Pat. Nos. 2,945,771 to Mansfeld and 3,219,448 to LuValle et al. describe methods by which such films may be deposited on substrates such as glass or plastic, while a detailed discussion of the deposition, processing and performance of evaporated silver bromide films is provided by A. Shepp et al. in "Evaporated Silver Bromide as a Photographic Recording Medium", *Photographic Science and Engineering,* 11, (5), pp. 316–321 (1967).

U.S. Pat. Nos. 3,219,452 to Hartouni, 3,368,895 to Matejic et al., and 3,658,540 to Malinowski describe materials and/or methods which have been employed to sensitize such photographic films, in order to enhance the latent image formation or chemical developability thereof. These patents also describe techniques for achieving positive images. In general, binder-free photographic films of the kind described in the above-cited literature are adapted for use in a conventional photographic mode, i.e., a mode wherein the steps of latent image formation by exposure to light and image development by chemical means are required to provide an image of suitable optical density.

Binder-free silver halide based compositions have also been employed in photochromic films, which are films typically exhibiting the properties of visible darkening on exposure to actinic radiation (e.g., short wavelength visible or ultraviolet light) and fading to the original state in the absence thereof. U.S. Pat. No. 3,512,869 to Plumat et al. describes photochromic films incorporating evaporated silver halides or the halides of other metals, which films darken in sunlight and fade in darkness. These films may be catalyzed with copper, cadmium or nickel halides to make them more sensitive to yellow or red visible light, if desired. U.S. Pat. No. 3,875,321 to Gliemeroth and French Patent No. 2,236,196 are additional patents disclosing reversibly darkenable photochromic films, while in the *Soviet Journal of Optical Technology,* pp. 117–118 (February 1972), A. F. Perveyev et al. describe AgCl-CuCl photochromic coatings.

Generally, rapid darkening in the presence of light and fast fading in the absence thereof are the properties most desired in photochromic films. Hence such films are not suitable photographic media because they do not provide a permanent record of the darkening or fading processes.

A photosensitive medium which could photographically preserve images without the use of chemical developers would offer obvious processing advantages, particularly if it would provide a positive image of the photographed subject matter. One medium recently developed for optical information storage applications, described in our copending, commonly assigned U.S. patent application Ser. No. 86,690, filed Oct. 22, 1979, can be directly darkened by exposure to ultraviolet light to provide a good contrast negative image. That medium comprises binder-free tin oxide and doped silver chloride, deposited by thermal evaporation as a mixture or as alternating layers of tin oxide and doped silver chloride, wherein the silver chloride is doped with cadmium chloride and, optionally, copper chloride.

When provided as a thin film on a suitable substrate this medium provides very high resolution as needed for digital information storage applications. However, the information is stored as a negative rather than a positive image.

SUMMARY OF THE INVENTION

The present invention involves the use of a doped silver chloride-tin oxide photosensitive medium to provide a positive image of a photographed subject without a chemical development step. The medium of the invention is a multilayer medium, typically provided as a multilayer polycrystalline coating or film on a suitable substrate, comprising two or more layers of tin oxide alternating with two or more layers of doped silver chloride, the doped silver chloride layers consisting essentially of silver chloride and, as dopants, cuprous chloride, cupric chloride and silver iodide.

Positive imaging in accordance with the invention is accomplished by first selectively exposing the multilayer medium provided as above described to ultraviolet light. This selective exposure, in the pattern of the subject to be photographed, causes selective darkening of the exposed portions such that a visible negative image of the subject is created in the exposed medium.

Following the exposure step, the selectively darkened medium is given a heat treatment. This heating step accomplishes a dual result, bleaching the selectively darkened portions of the medium and at the same time strongly darkening the unexposed portions thereof. In effect, then, the heating step reverses the optical density relationship between the exposed and unexposed portions of the negative image first produced and intensifies contrast so that a directly viewable positive image of the subject is provided. No further development steps or chemical treatments are required, and the positive image exhibits good stability under normal room lighting.

BRIEF DESCRIPTION OF THE DRAWING

The invention may be further understood by reference to the drawing, wherein.

DETAILED DESCRIPTION

Figure 1:
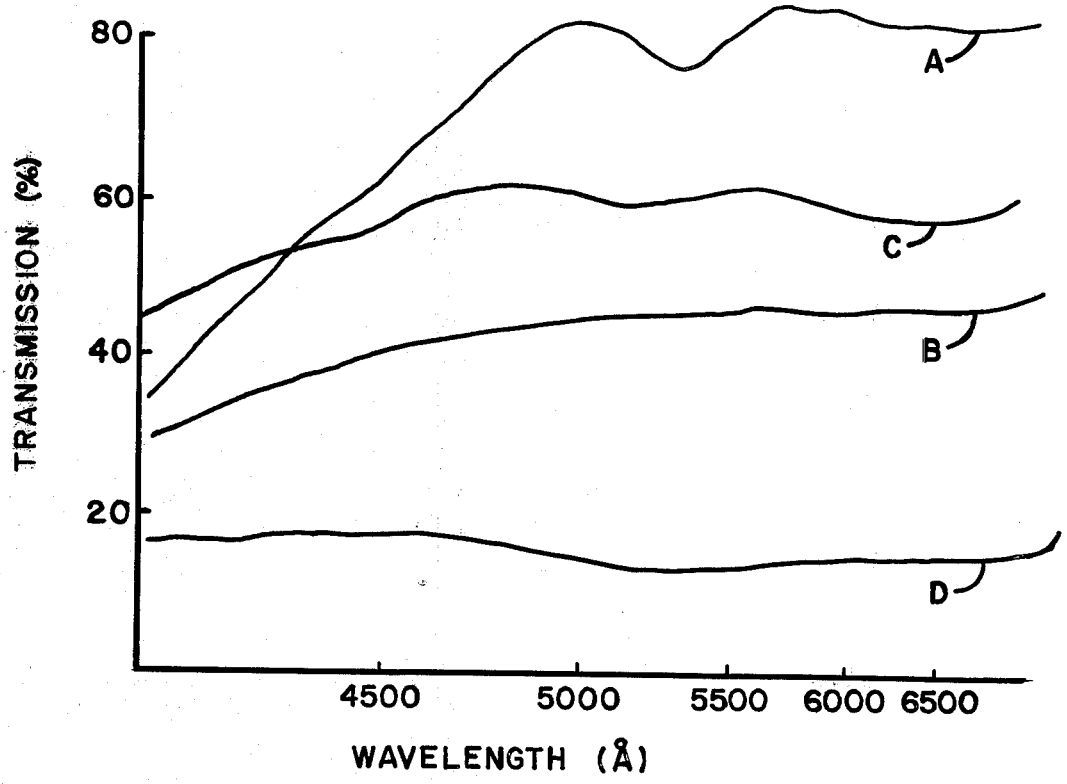
FIG. 1 is a graph plotting light transmittance as a function of wavelength for a photosensitive thin-film medium at various stages of treatment in accordance with the invention.

The method of choice for producing a photosensitive thin-film medium for use in the invention is that of vacuum deposition, preferably by thermal evaporation, although other techniques, such as the deposition of the tin oxide component by ion beam sputtering, could alternatively be employed. In the case of thermal evaporation, deposition chamber pressures typically range from about $10^{-3}$ to about $10^{-6}$ torr, depending upon the particular deposition procedure employed.

In its most convenient form the medium is provided as a thin multilayer film on a suitable substrate. The thickness of the film is not critical, typically ranging from about 0.1–2 microns, although thicker films could also be used. The film will ordinarily comprise at least two and preferably 5–10 doped silver chloride layers alternating with approximately the same number of tin oxide layers. Either constituent may be deposited first on the substrate, but tin oxide usually forms the last layer to be applied.

The material employed as a film substrate is not critical. Thus the substrate can comprise any rigid or flexible glass or plastic material in sheet form which is or can be made sufficiently inert to the film-forming materials and sufficiently heat-resistant so that the substrate will not interact with the film during film deposition or use in a manner which will interfere with the optical sensitivity thereof.

The source of the silver halides, copper chlorides and tin oxide to be incorporated in the deposited film is likewise not critical. Chemically pure AgCl, CuCl, $CuCl_2$, AgI and $SnO_2$ constitute suitable starting materials where deposition to be by conventional thermal evaporation techniques.

Although $SnO_2$ is the preferred starting material for incorporating evaporated tin oxide into these films, some reduction of tin probably occurs in the course of evaporation and deposition, reducing the oxygen concentration in the deposited oxide. This is thought to occur even under a particularly preferred deposition procedure wherein a slight partial pressure of oxygen (e.g., $10^{-3}$ torr of $O_2$) is maintained in the deposition chamber during $SnO_2$ evaporation. Nevertheless, while the final oxygen concentration has not been exactly determined, it is believed that there are between 1 and 2 atoms of oxygen for each atom of tin in the ultimately deposited film.

Deposition of the doped silver chloride film component by thermal evaporation can conveniently be accomplished by evaporating a source material which is a product of fusion of the compounds making up this component of the film. A homogeneous mixture of AgCl, CuCl, $CuCl_2$ and AgI in the proportions desired for use in the film is heated in an oven at a temperature sufficient to fuse the mixture, and the fused product is then used in the evaporation process.

The invention may be further understood by reference to the following illustrative Example.

EXAMPLE

A doped silver chloride source material containing silver chloride, cuprous and cupric chloride and silver iodide in a weight ratio (AgCl:CuCl:$CuCl_2$:AgI) of about 3.75:1.25:0.75:1 is provided by mixing 3.75 grams of AgCl, 1.25 grams of CuCl, 0.75 grams of $CuCl_2$ and 1 gram of silver iodide in a crucible and heating the mixture to fusion in an oven at 500° C. The fusion product is then placed in an electrically heatable tungsten evaporation boat in a vacuum chamber, the chamber also being provided with a second, independently heatable evaporation boat containing a quantity of $SnO_2$.

A glass slide is positioned over the evaporation boats in the chamber and the chamber is sealed and evacuated to a pressure of about $10^{-6}$ torr. The evaporation boat containing the silver halide-copper chloride fusion product is then heated to initiate vaporization of the contents, and vaporization is continued until a doped silver chloride layer about 200Å in thickness is deposited on the slide.

The evaporation boat containing the doped silver chloride is then allowed to cool and the chamber is backfilled with oxygen to a pressure of about $10^{-3}$ torr while the $SnO_2$-containing boat is heated to initiate vaporization of tin oxide. Vaporization is continued at this oxygen pressure until a tin oxide layer about 200Å in thickness has been deposited over the doped silver halide layer on the slide. The tin oxide-containing boat is then permitted to cool.

The above-described sequence of doped silver halide layer deposition and tin oxide deposition is repeated until a film comprising 5 doped silver chloride layers alternating with 5 tin oxide layers has been deposited on the substrate. Air is then readmitted to the vacuum chamber and the glass slide supporting the evaporated film is removed and examined.

The photosensitive film thus provided is found to exibit the light transmission characteristics indicated by Curve A in FIG. 1 of the drawing, being fairly transparent to visible radiation but with increasing absorption at shorter visible wavelengths.

To test the response characteristics of the film, selected regions thereof are exposed to ultraviolet light from a 100-Watt mercury arc source, focused to a 2 cm. spot, for an interval of 5 minutes. Following this exposure it is found that visible darkening of the exposed regions of film has occurred. The light transmission characteristics of the darkened exposed regions are shown by Curve B in FIG. 1 of the drawing.

Following the exposure step, the entire film is subjected to a brief one-minute heat treatment at 300° C. The first effect of this treatment is that the darkened exposed regions of the film are bleached, resulting in the light transmittance characteristics shown in Curve C of FIG. 1 of the drawing. In addition, the heat treatment causes substantial darkening of the unexposed regions of the film, the unexposed regions exhibiting the light transmission characteristics shown by Curve D of FIG. 1 of the drawing following the heat treatment.

Figure 2:
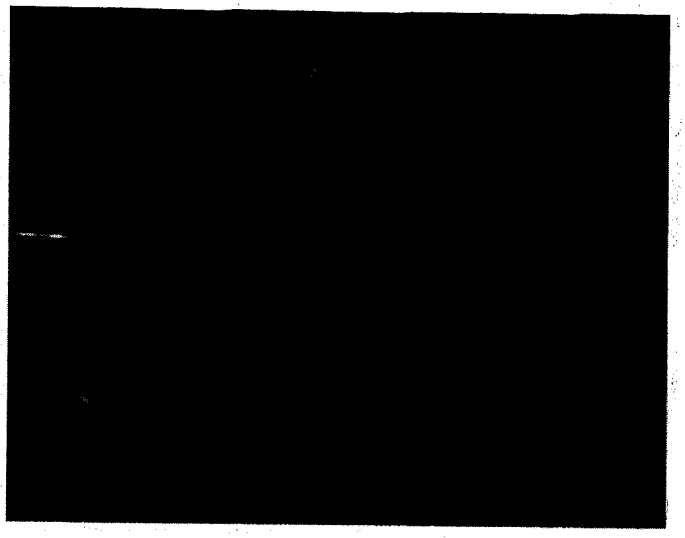
FIG. 2 is a photomicrograph showing a photographic test pattern provided in a photosensitive medium in accordance with the invention.

A photographic test pattern resulting from the processing of the film of the Example in accordance with the procedure described therein is shown in FIG. 2 of the drawing. FIG. 2 is a positive image of the pattern, shown at a magnification of 43.7X. Although the resolution of the medium is not high, this disadvantage is more than offset for many applications by the elimination of any requirement for chemical development.

Of course the foregoing Example is merely illustrative of photosensitive materials and techniques for making and using them which could be employed in practicing the invention as hereinabove described. For example, it is anticipated that substantial variations in doping levels can be tolerated, such that films comprising 15–25% CuCl, 5–15% $CuCl_2$, and 10–20% AgI by weight are expected to exhibit acceptable darkening response without loss of the desired imaging characteristics, provided the composition of the silver halide component remains predominantly (at least 50 weight %) silver chloride. Similarly, although the thickness of the doped silver chloride layers will preferably fall in the range of about 150–300Å, and the thickness of the tin oxide layers in the range of 100–300Å, considerable variation in the thicknesses of these layers is thought to be possible within the scope of the invention as hereinabove described.

We claim:

1. A method for forming a positive image in a photosensitive medium which comprises the steps of:

(a) providing a multilayer photosensitive medium comprising alternating layers of doped silver halide and tin oxide on a substrate, the doped silver halide layers consisting essentially, in weight percent, of at least about 50% AgCl, 15–25% CuCl, 5–15% $CuCl_2$ and 10–20% AgI by weight;

(b) selectively exposing the medium to ultraviolet light for a time sufficient to achieve darkening of the exposed portions; and (c) heating the medium at a temperature and for a time sufficient to bleach the darkened exposed portions and to darken the unexposed portions thereof.

2. A method in accordance with claim 1 wherein the weight ratio AgCl:CuCl:$CuCl_2$:AgI in the doped silver halide layers is about 3.75:1.25:0.75:1.

3. A photosensitive medium for forming a positive image of a subject which comprises alternating layers of doped silver halide and tin oxide on a substrate, the doped silver halide layers consisting essentially, in weight percent, of at least about 50% AgCl, 15–25% CuCl, 5–15% $CuCl_2$ and 10–20% AgI.

4. A photosensitive medium in accordance with claim 3 wherein the weight ratio AgCl:CuCl:$CuCl_2$:AgI is about 3.75:1.25:0.75:1.

* * * * *